US005365019A

United States Patent [19]

Usa

[11] Patent Number: 5,365,019

[45] Date of Patent: Nov. 15, 1994

[54] TOUCH CONTROLLER FOR AN ELECTRONIC MUSICAL INSTRUMENT

[75] Inventor: Satoshi Usa, Hamamatsu, Japan

[73] Assignee: Yamaha Corporation, Japan

[21] Appl. No.: 29,999

[22] Filed: Mar. 11, 1993

Related U.S. Application Data

[63] Continuation of Ser. No. 500,803, Mar. 28, 1990, abandoned.

[30] Foreign Application Priority Data

Mar. 30, 1989 [JP] Japan ..... 1-76623

[51] Int. Cl.[5] ..... G10H 1/02; G10H 1/18

[52] U.S. Cl. ..... 84/658; 84/DIG. 7

[58] Field of Search ..... 84/609-620, 84/622-626, 633-638, DIG. 12, 658-665, DIG. 7

[56] References Cited

U.S. PATENT DOCUMENTS 4,301,704 11/1981 Nagai et al. ..... 84/626
4,887,505 12/1989 Suzuki ..... 84/DIG. 12
4,903,565 2/1990 Abe ..... 84/611

FOREIGN PATENT DOCUMENTS 61-14518 4/1986 Japan .

*Primary Examiner*—Stanley J. Witkowski
*Attorney, Agent, or Firm*—Graham & James

[57] ABSTRACT

A touch controller according to the present invention can allow both wide expression and easy play of an electronic musical instrument by controlling a degree of the initial touch effect based on performance data in real time. According to the present invention, a width of a tone volume or an attack speed of a musical tone which can be controlled according to initial touch data is controlled in real time based on another performance data. As another performance data, an elapse time from a key OFF event of an immediately preceding performance tone or an elapse time from a key ON event of an immediately preceding performance tone may be used.

5 Claims, 4 Drawing Sheets

TOUCH CONTROLLER FOR AN ELECTRONIC MUSICAL INSTRUMENT

This application is a continuation application of Ser. No. 07,500,803, filed Mar. 28, 1990, now abandoned.

BACKGROUND OF THE INVENTION

1. Field of the Invention

The present invention relates to a touch controller used in an electronic musical instrument and, more particularly, to a touch controller which can allow both wide expression and easy play of an electronic musical instrument by controlling a degree of the touch effect based on performance data in real time.

2. Description of the Prior Art

In a conventional electronic musical instrument, an initial touch (velocity) at a keyboard or the like is detected, and a tone volume or a tone rising speed is changed based on initial touch data. In this case, a control range of a tone volume or the like according to the initial touch data is fixed to a range corresponding to a width of expression of an acoustic musical instrument.

However, when a width of the control range of a tone volume or the like according to the initial touch data is fixed to be almost equal to the width of expression of an acoustic musical instrument, a tone volume or the like tend to overrespond to a change in initial touch data, and a variation in touch of a performer becomes conspicuous, instead.

Contrary to this, when the width of the control range is narrowed to allow easy play, the width of expression as an electronic musical instrument is also undesirably narrowed.

As for an attacking speed of musical tone, since an attacking speed is fixed for one tone color, another tone color must be selected to change the attacking speed.

SUMMARY OF THE INVENTION

It is therefore an object of the present invention to provide a touch controller which can solve the conventional drawbacks, and can attain both wide expression and easy play in an electronic musical instrument.

In order to achieve the above object, according to the present invention, a width of a tone volume or an attack speed of a musical tone which can be controlled according to initial touch data is controlled in real time based on another performance data. As another performance data, an elapse time from a key OFF event of an immediately preceding performance tone or an elapse time from a key ON event of an immediately preceding performance tone may be used.

FIG. 1 is a schematic block diagram showing an arrangement of an initial touch controller according to the present invention. In this case, a tone rising speed or a tone volume is controlled based on an elapse time from a key OFF event of an immediately preceding performance tone. More specifically, an elapse time from a key OFF event of an immediately preceding performance tone is measured, and when this time is considerably long, the degree of the touch (velocity) effect with respect to the corresponding performance tone is increased.

In FIG. 1, reference numeral 1 denotes an initial touch detection means for detecting initial touch (velocity) data when a keyboard of an electronic keyboard instrument is depressed; and 2, a timer which is reset upon detection of a key OFF event at the keyboard to measure an elapse time after the key OFF event. Reference numeral 3 denotes a calculation means for substituting the time value from the key OFF event in a predetermined membership function to obtain a value a which varies between "0" and "1" and indicates a degree of establishment of a proposition "a considerable time has elapsed after an OFF event of a previously depressed key". Reference numeral 4 denotes an arithmetic means for converting touch data v based on the value a using predetermined arithmetic formulas, and outputting converted output touch data $v_{OUT}$.

Note that a, v, and $v_{OUT}$ can take the following values.

a: Real number between "0" and "1" indicating a degree of establishment of the proposition "a considerable time has elapsed after an OFF event of a previously depressed key"

v: Integer between "0" and "127" as initial touch data $v_{OUT}$: Integer between "0" and "127" as output touch data The following arithmetic formulas of the arithmetic means are used.

$$v_{OUT} = (v - 64) \times a + 64 \quad \text{(i)}$$

$$v_{OUT} = (v - 64) \times a^2 + 64 \quad \text{(ii)}$$

$$v_{OUT} = (v - 64) \times \sin\frac{\pi a}{2} + 64 \quad \text{(iii)}$$

FIG. 2 is a graph showing the relationship between the touch data v and the output touch data $v_{OUT}$ when the arithmetic formula (i) described above is used. When a considerable time has elapsed after an OFF event of a previously depressed key, the value a takes "1" or a value approximate to and smaller than "1". Therefore, in this case, the input v and the output $v_{OUT}$ have the relationship indicated by a graph (1), and a width of a change in tone volume caused by a keyboard touch of a performer is large (i.e., high sensitivity is set). On the other hand, when the next key is depressed before a considerable time has passed from an OFF event of a previously depressed key, the value a takes "0" or a value approximate to and larger than "0". Therefore, in this case, the input v and the output $v_{OUT}$ have the relationship represented by a graph (3). Thus, a width of a change in tone volume or the like caused by a keyboard touch of the performer is smaller (i.e., low sensitivity is set). In this manner, an inclination is changed like in graphs in FIG. 2 in accordance with the value a, thus controlling a degree of the initial touch effect in real time.

DETAILED DESCRIPTION OF THE PREFERRED EMBODIMENT

An embodiment of the present invention will be described below with reference to the accompanying drawings.

Figure 3:
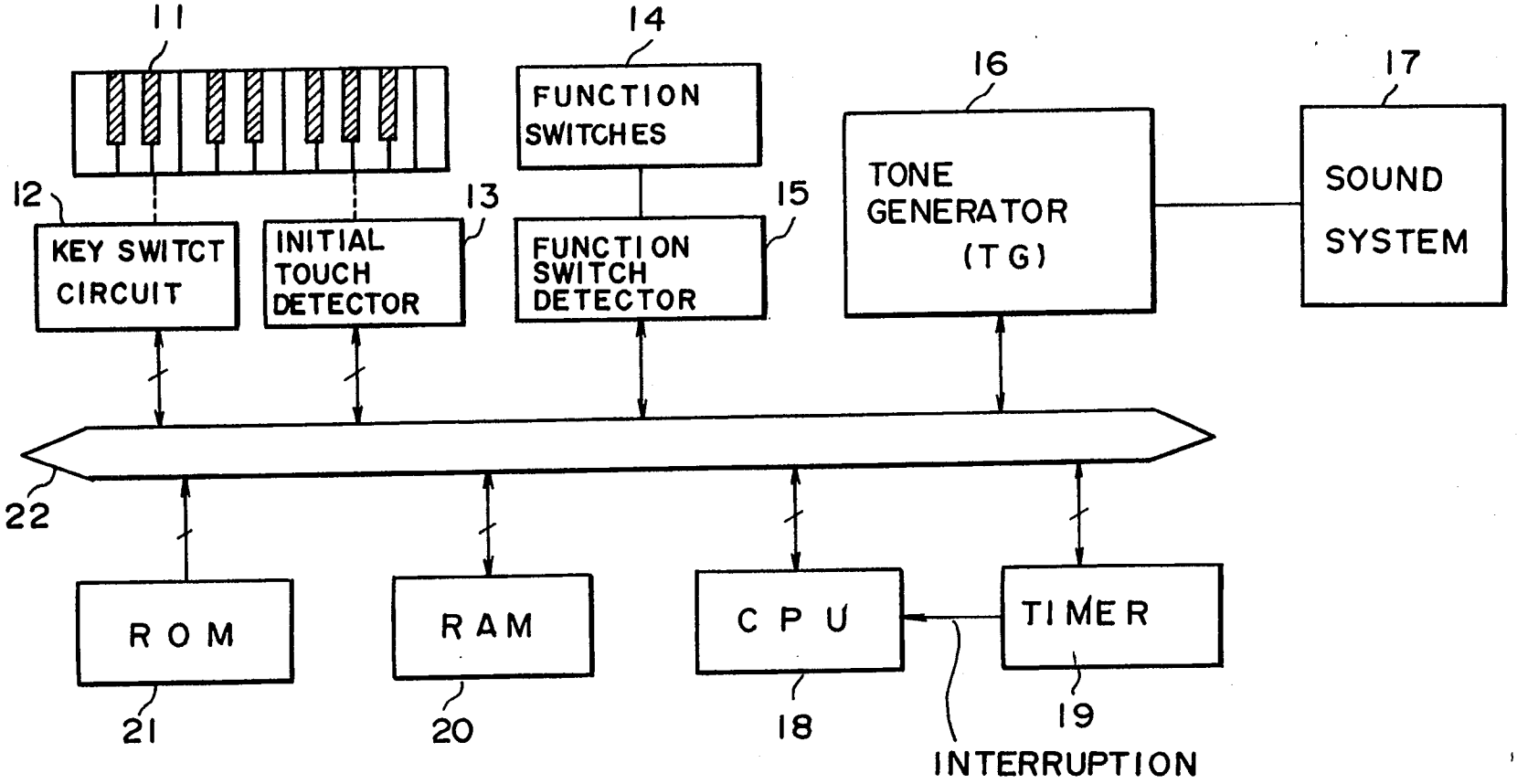
FIG. 3 is a block diagram of an electronic keyboard instrument to which an embodiment of an initial touch controller according to the present invention is applied.

FIG. 3 is a block diagram showing a schematic arrangement of an electronic keyboard instrument to which an embodiment of an initial touch controller according to the present invention is applied. In FIG. 3, reference numeral 11 denotes a keyboard of the electronic keyboard instrument; 12, a key switch circuit for detecting an ON/OFF event of each key of the keyboard; 13, an initial touch detector for detecting an initial touch when a key on the keyboard is depressed; 14, various function switches; 15, a function switch detector for detecting an operation of the function switches 14; 16, a tone generator (TG); and 17, a sound system. Reference numeral 18 denotes a central processing unit (CPU) for controlling the operation of the entire electronic keyboard instrument; 19, a timer used for timer interruption; 20, a random-access memory (RAM) serving as working registers, and the like; and 21, a read-only memory (ROM) for storing programs, various table data, and the like. These sections are connected to each other through a bidirectional bus line 22, as shown in FIG. 3.

Registers used in the electronic keyboard instrument of this embodiment will be explained below:

1. BUF: Register for storing a key code for which a corresponding tone is to be produced
2. v: Register for storing initial touch data detected by the initial touch detector 13 when a performer depresses a key on the keyboard 11
3. $v_{OUT}$: Register for storing output initial touch data output to a sound source
4. TIME: Register for measuring a time
5. a: Register for storing a real number between "0" (indicating false) and "1" (indicating truth) representing a degree of establishment of a proposition "a considerable time has elapsed after an OFF event of a previously depressed key"
6. TBL: Table used for deriving the value a from the time value TIME
7. KOF: Key OFF flag which takes "1" when all channels of the tone generator 16 are set in a key OFF state; otherwise, "0"

Figure 4:
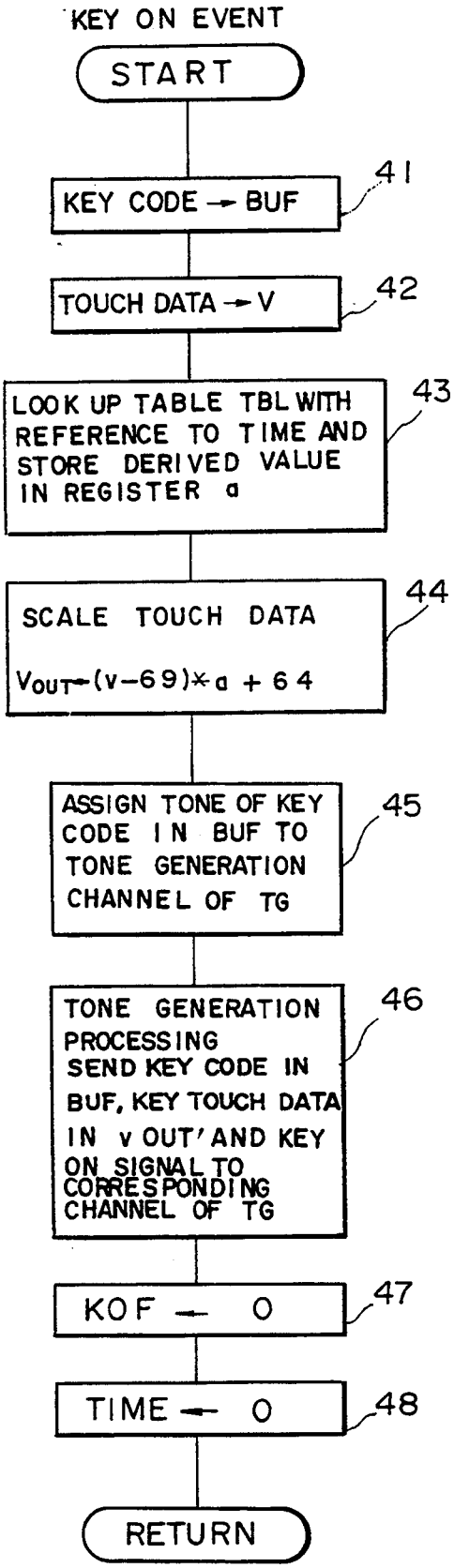
FIG. 4 is a flow chart of a key ON event routine of the electronic keyboard instrument of the embodiment shown in FIG. 3.
Figure 5:
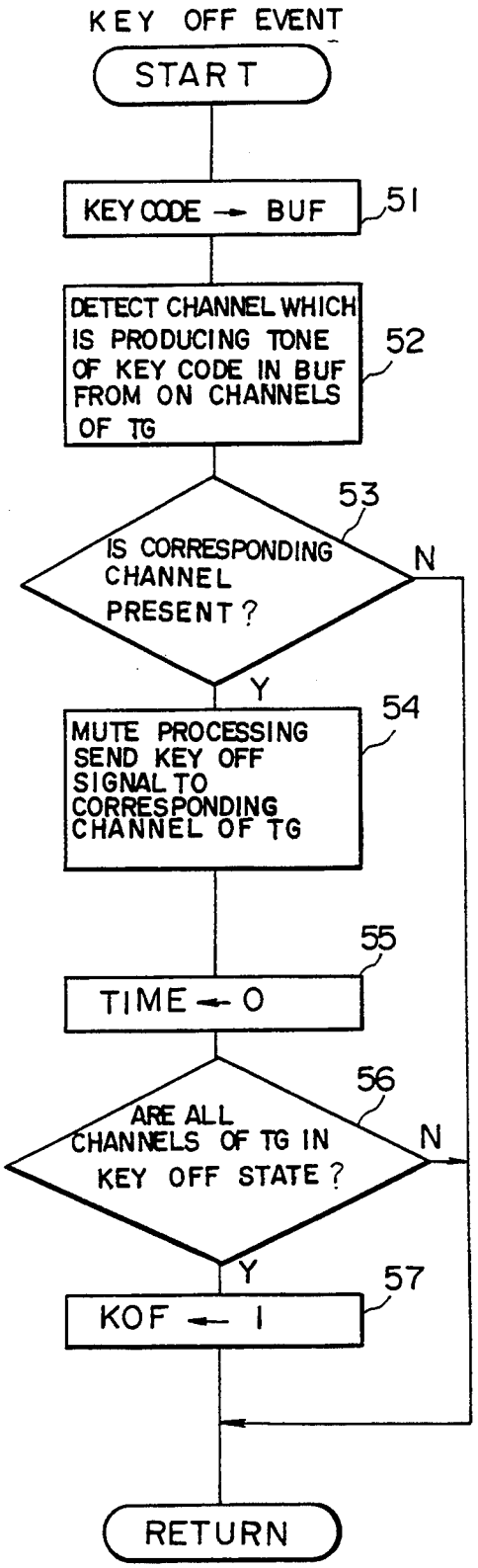
FIG. 5 is a flow chart of a key OFF event routine of the electronic keyboard instrument of the embodiment shown in FIG. 3.
Figure 6:
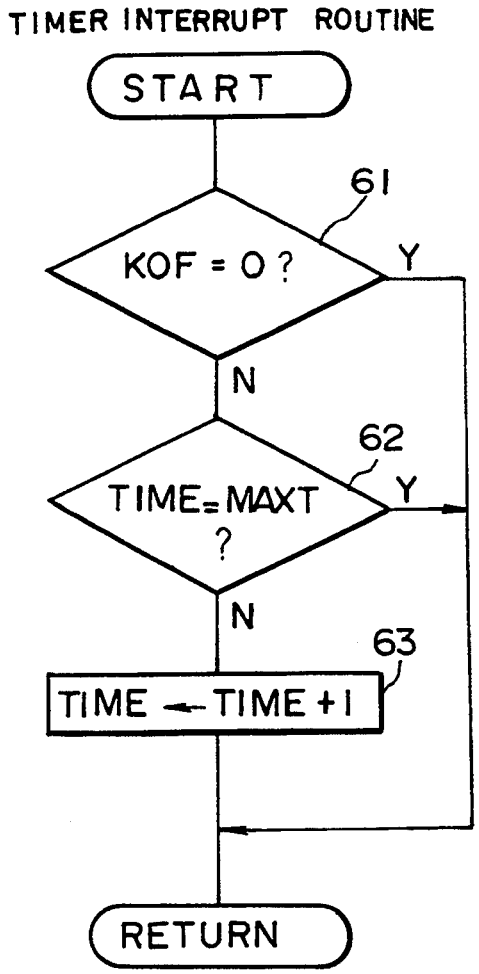
FIG. 6 is a flow chart of a timer interrupt routine of the electronic keyboard instrument of the embodiment shown in FIG. 3.

An operation of the electronic keyboard instrument shown in FIG. 3 will be described below with reference to the flow charts of FIGS. 4 to 6.

Processing when a key ON event occurs will first be described below with reference to FIG. 4. The key ON event routine is called from the main routine (not shown) when a key ON event occurs. When a key ON event occurs, a key code of the ON key is stored in the register BUF in step 41, and its initial touch data is stored in the register v in step 42. In step 43, the table TBL is looked up with reference to the time value TIME to obtain a corresponding value therefrom, and the obtained value is stored in the register a. Thus, the value representing the degree of establishment of the proposition "a considerable time has elapsed after an OFF event of a previously depressed key" is stored in the register a. Note that the time value TIME is obtained by counting an elapse time from the OFF event of a previously depressed key in a sequence to be described later.

In step 44, the touch data v is scaled based on the value a. In this case, as the arithmetic formula, arithmetic formula (i) described above is used:

$$v_{OUT}=(v-64)\times a+64 \quad \text{(i)}$$

In step 45, a tone of the key code stored in the register BUF is assigned to a tone generation channel of the tone generator 16, and is subjected to tone generation processing in step 46. In the tone generation processing, the key code in the register BUF, the output touch data in the register $v_{OUT}$, and a key ON signal are sent to the corresponding channel of the tone generator. In step 47, the KOF flag is reset to "0". In step 48, the register TIME is cleared to zero, and the flow then returns to the main routine.

Key OFF event processing will be described below with reference to FIG. 5. The key OFF event routine is called from the main routine (not shown) when a key OFF event occurs. When a key OFF event occurs, a key code of the OFF key is stored in the register BUF in step 51.

In step 52, a channel which is producing a tone of the key code in the register BUF is detected from ON channels of the tone generator 16. In step 53, the presence/absence of the corresponding channel is checked. If there is no corresponding channel, key OFF processing need not be executed, and the flow directly returns to the main routine. When the corresponding channel is detected, mute processing is executed in step 54.

In the mute processing, a key OFF signal is sent to the corresponding channel of the tone generator 16. In step 55, the register TIME is cleared to zero, and it is checked in step 56 if all the channels of the tone generator 16 are set in a key OFF state. If YES (Y) in step 56, "1" is set in the KOF flag in step 57, and the flow then returns to the main routine; otherwise, the flow directly returns to the main routine.

Timer interrupt processing will be described below with reference to FIG. 6. The timer interrupt routine shown in FIG. 6 is executed as the timer interrupt processing when a timer interruption occurs at a predetermined time interval by the timer 19 (FIG. 3). When a timer interruption occurs, it is checked in step 61 if the KOF flag is "0". If YES in step 61, this means that a certain channel of the tone generator 16 is set in a key ON state. Thus, the register TIME is not incremented, and the flow directly returns to the main routine. If NO (N) in step 61, it is checked in step 62 if the value of the register TIME exceeds a predetermined maximum value MAXT. If YES in step 62, the flow directly returns to the main routine. If NO in step 62, the time TIME is incremented in step 63, and the flow returns to the main routine.

In this embodiment, when a key OFF event occurs and all the channels of the tone generator are set in a key OFF state, the register TIME is cleared to zero, and "1" is set in the KOF flag in steps 55 and 57 in the key OFF event routine. While the KOF flag is kept set, the register TIME is incremented in step 63 in the timer interrupt routine until it reaches the maximum value MAXT. When the next key ON event occurs, the value a is calculated from the elapse time TIME from the key OFF event of the previously depressed key, and the output touch data $v_{OUT}$ is calculated using the predetermined arithmetic formula in step 44 in the key ON event routine. Then, the tone generation processing is executed based on the output touch data $v_{OUT}$.

Figure 1:
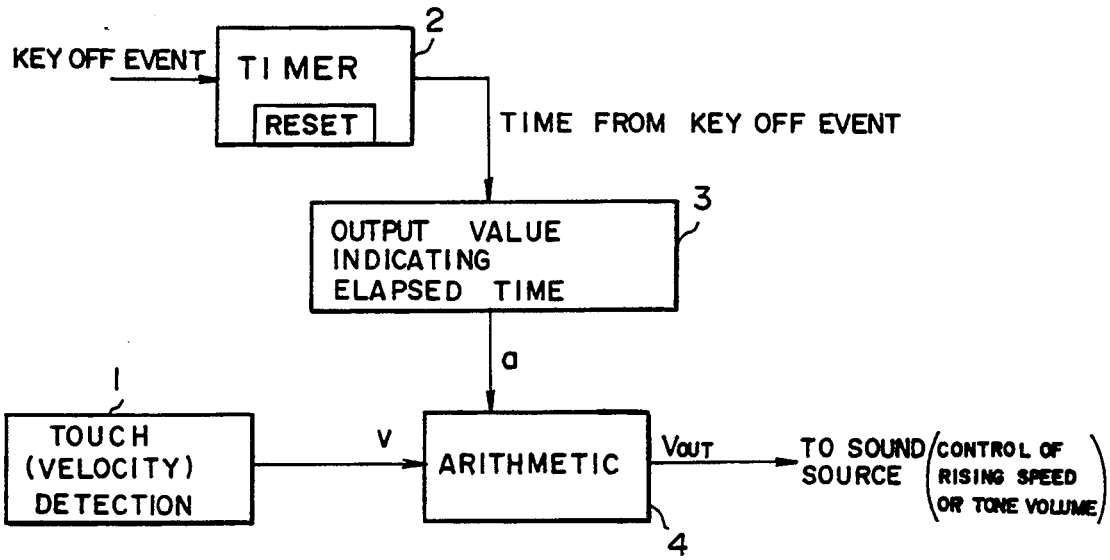
FIG. 1 is a schematic block diagram of an initial touch controller according to the present invention.
Figure 2:
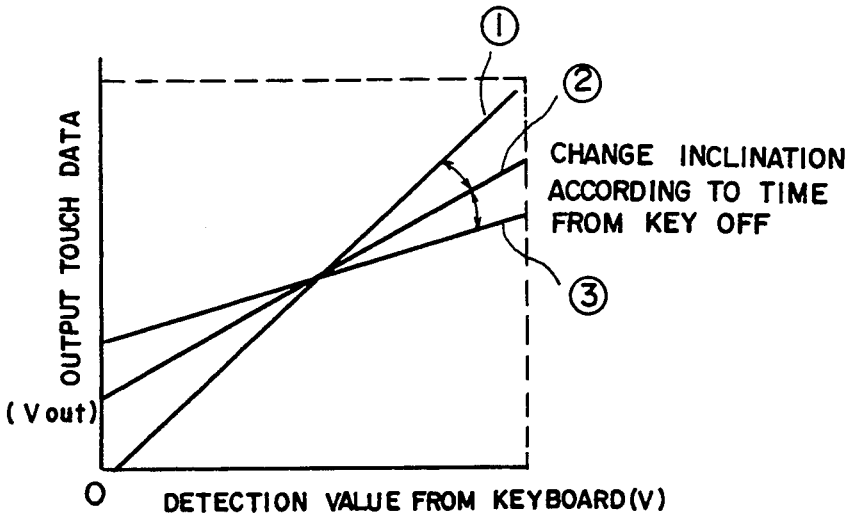
FIG. 2 is a graph showing relationships between touch data v and output touch data $v_{OUT}$.

In the above embodiment, as the arithmetic formula for scaling, a formula of changing an inclination with a fixed central value, e.g., the formula shown in the graph of FIG. 2 is used. However, the present invention is not limited to this, and various arithmetic formulas may be used. For example, the central value of possible values of touch data detected from the keyboard need not be set at the center of inclination, but an inclination may be changed to have a value of detected touch data of a previously depressed key as the center. In this case, the value of touch data can be approximate to the previous value when touch data is almost equal to the previous touch data is detected.

As described above, according to the present invention, a width of a tone volume or a tone rising speed which can be controlled by initial touch data is controlled in real time on the basis of an elapse time from an OFF or ON event of a previously depressed key, thus changing a degree of the touch effect. Therefore, a parameter to be controlled can be prevented from overresponding to a change in initial touch, and, hence, a variation in touch of a performer can be prevented from becoming conspicuous. Thus, both wide expression and easy play as an electronic musical instrument can be attained.

What is claimed is:

1. A touch controller for an electronic musical instrument having keys which are depressed to generate tones, comprising:

touch detection means for detecting touch data in response to depression of a key;

means for acquiring and outputting performance data in response to depression of a key, said performance data representing a performance characteristic of the electronic musical instrument other than touch; and arithmetic means for performing a predetermined arithmetic operation using the touch data detected by said touch detection means and the performance data, and for outputting modified touch data obtained as a result of the arithmetic operation to a sound source of the electronic musical instrument so as to control a degree of a touch effect based on the performance data every time a key is depressed wherein the performance data for a particular key includes an elapsed time from an OFF or ON event of a previously depressed key to the depression of the particular key.

2. A touch controller according to claim 1, wherein said degree of touch effect is an extent of change of a touch effect.

3. A touch controller for an electronic musical instrument having plural keys comprising;

touch detection means for detecting key touch data representing touch intensity in response to depression of a key;

output means for acquiring and outputting performance data, representing a performance parameter other than touch intensity, in response to depression of a key; and arithmetic means for performing a predetermined arithmetic operation using current key touch data detected by said touch detection means according to a current key depression and previous performance data outputted by said output means according to a previous key depression prior to the current key depression, and for outputting a result of the arithmetic operation as modified key-touch data to a sound source so as to control a degree of a touch effect according to the modified key-touch data.

4. A touch controller according to claim 3, wherein the performance data includes an elapsed time from one of an OFF or ON event of the previously depressed key.

5. A touch controller according to claim 3, wherein said degree of a touch effect is an extent of change of a touch effect.

* * * * *